US005916142A

United States Patent [19]

Snyder et al.

[11] Patent Number: 5,916,142

[45] Date of Patent: Jun. 29, 1999

[54] SELF-ALIGNING SWIRLER WITH BALL JOINT

[75] Inventors: Charles A. Snyder, Liberty, Ind.; Harold R. Hansel, Mason; George E. Cook, Cincinnati, both of Ohio

[73] Assignee: General Electric Company, Cincinnati, Ohio

[21] Appl. No.: 08/734,163

[22] Filed: Oct. 21, 1996

[51] Int. Cl.[6] ..... F02C 7/20; F02G 3/00

[52] U.S. Cl. ..... 60/748; 60/39.32; 60/740

[58] Field of Search ..... 60/39.36, 39.31, 60/39.32, 737, 740, 747, 748; 239/424, 404, 406

[56] References Cited

U.S. PATENT DOCUMENTS

| | | | |
|---|---|---|---|
| 3,451,215 | 6/1969 | Barr | 60/39.32 |
| 3,866,413 | 2/1975 | Sturgess | 60/748 |
| 3,879,940 | 4/1975 | Stenger et al. | 60/39.32 |
| 3,901,446 | 8/1975 | Petreikis, Jr. et al. | 239/132.5 |
| 3,972,182 | 8/1976 | Salvi | 60/748 |
| 4,198,815 | 4/1980 | Bobo et al. | 60/748 |
| 4,290,558 | 9/1981 | Coburn et al. | 60/748 |
| 4,365,470 | 12/1982 | Matthews et al. | 60/39.32 |
| 4,454,711 | 6/1984 | Ben-Porat | 60/748 |
| 4,815,664 | 3/1989 | Tuthill et al. | 239/406 |
| 4,870,818 | 10/1989 | Suliga | 60/740 |
| 4,999,996 | 3/1991 | Duchene et al. | 60/39.32 |
| 5,197,290 | 3/1993 | Lee et al. | 60/748 |
| 5,222,358 | 6/1993 | Chaput et al. | 60/39.32 |
| 5,321,951 | 6/1994 | Falls et al. | 60/748 |
| 5,323,604 | 6/1994 | Ekstedt et al. | 60/39.36 |
| 5,333,459 | 8/1994 | Berger | 60/748 |
| 5,479,772 | 1/1996 | Halila | 60/39.32 |
| 5,577,379 | 11/1996 | Johnson | 60/740 |

*Primary Examiner*—Timothy S. Thorpe
*Assistant Examiner*—Ted Kim
*Attorney, Agent, or Firm*—Andrew C. Hess; Rodney M. Young

[57] ABSTRACT

A swirler is provided for mixing air from a compressor and fuel from a fuel injector for discharge into a dome of a gas turbine engine combustor. The swirler includes a tubular ferrule for coaxially receiving the fuel injector. A plurality of circumferentially spaced apart swirl vanes are fixedly joined coaxially with the ferrule. An outlet tube is fixedly joined coaxially with the swirl vanes in flow communication therewith for receiving air from the swirlers and fuel from the fuel injector. An annular collar is fixedly joined around the outlet tube and has a convex spherical outer surface. An annular mounting flange for mounting the swirler to the combustor dome has a concave spherical inner surface disposed coaxially around the collar outer surface in a sliding fit therewith to define a ball joint for allowing relative rotation therebetween for self-aligning the fuel injector with the swirler.

12 Claims, 4 Drawing Sheets

SELF-ALIGNING SWIRLER WITH BALL JOINT

BACKGROUND OF THE INVENTION

The present invention relates generally to gas turbine engines, and, more specifically, to fuel systems therein.

A gas turbine engine includes a compressor which provides pressurized air to a combustor wherein it is mixed with fuel and ignited for generating hot combustion gases which flow downstream to one or more turbines which extract energy therefrom for powering the compressor and providing useful work such as powering an aircraft in flight. Two significant design objectives in an aircraft engine are fuel consumption and exhaust emissions. Aircraft engines continually undergo development for reducing fuel consumption or specific fuel consumption (SFC). And, since the engines produce exhaust emissions during flight, it is also desirable to reduce those emissions, including in particular NOx emissions which adversely affect atmospheric ozone.

The fuel is injected into the combustor using fuel injectors which take various forms and complexity for suitably atomizing the fuel for being mixed with air. The pressurized air provided by the compressor is introduced into the combustor through air swirlers which take various forms and provide one or more concentric air flowpaths around the injected fuel to provide a suitably mixed fuel and air mixture.

It is desirable to obtain concentricity of the swirled air around the injected fuel in all power levels of operation of the engine to maximize fuel and air mixing effectiveness for decreasing both SFC and NOx emissions. However, the fuel injectors are typically suspended from a combustor case, and the air swirlers are typically mounted to the combustor suitably supported inside the combustor case. These components are operated at different temperatures throughout the entire operating envelope of the engine, and are typically made from different materials which cause differential thermal expansion and contraction therebetween. Off-center fuel injection into the swirlers results in undesirably higher SFC and increased NOx emissions, and may also decrease the useful life of the swirlers themselves due to increased operating temperature thereof.

Alignment of the fuel injectors and the swirlers is also affected by the initial assembly of these components in the engine. The fuel injectors and swirlers are individually manufactured and are therefore subject to typical manufacturing tolerances causing random size variations from injector to injector and from swirler to swirler. And, the individual injectors and swirlers must be assembled into a complete assembly and are therefore also object to manufacturing stack-up tolerances which also affect the alignment between the individual fuel injectors in their respective air swirlers.

Accordingly, alignment inaccuracies between respective ones of fuel injectors and swirlers are inherently created in typical gas turbine engine combustors and adversely affect both SFC and NOx emissions. It is therefore desirable to improve the alignment between fuel injectors and their corresponding swirlers for improving both SFC and NOx emissions.

SUMMARY OF THE INVENTION

A swirler is provided for mixing air from a compressor and fuel from a fuel injector for discharge into a dome of a gas turbine engine combustor. The swirler includes a tubular ferrule for coaxially receiving the fuel injector. A plurality of circumferentially spaced apart swirl vanes are fixedly joined coaxially with the ferrule. An outlet tube is fixedly joined coaxially with the swirl vanes in flow communication therewith for receiving air from the swirlers and fuel from the fuel injector. An annular collar is fixedly joined around the outlet tube and has a convex spherical outer surface. An annular mounting flange for mounting the swirler to the combustor dome has a concave spherical inner surface disposed coaxially around the collar outer surface in a sliding fit therewith to define a ball joint for allowing relative rotation therebetween for self-aligning the fuel injector with the swirler.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
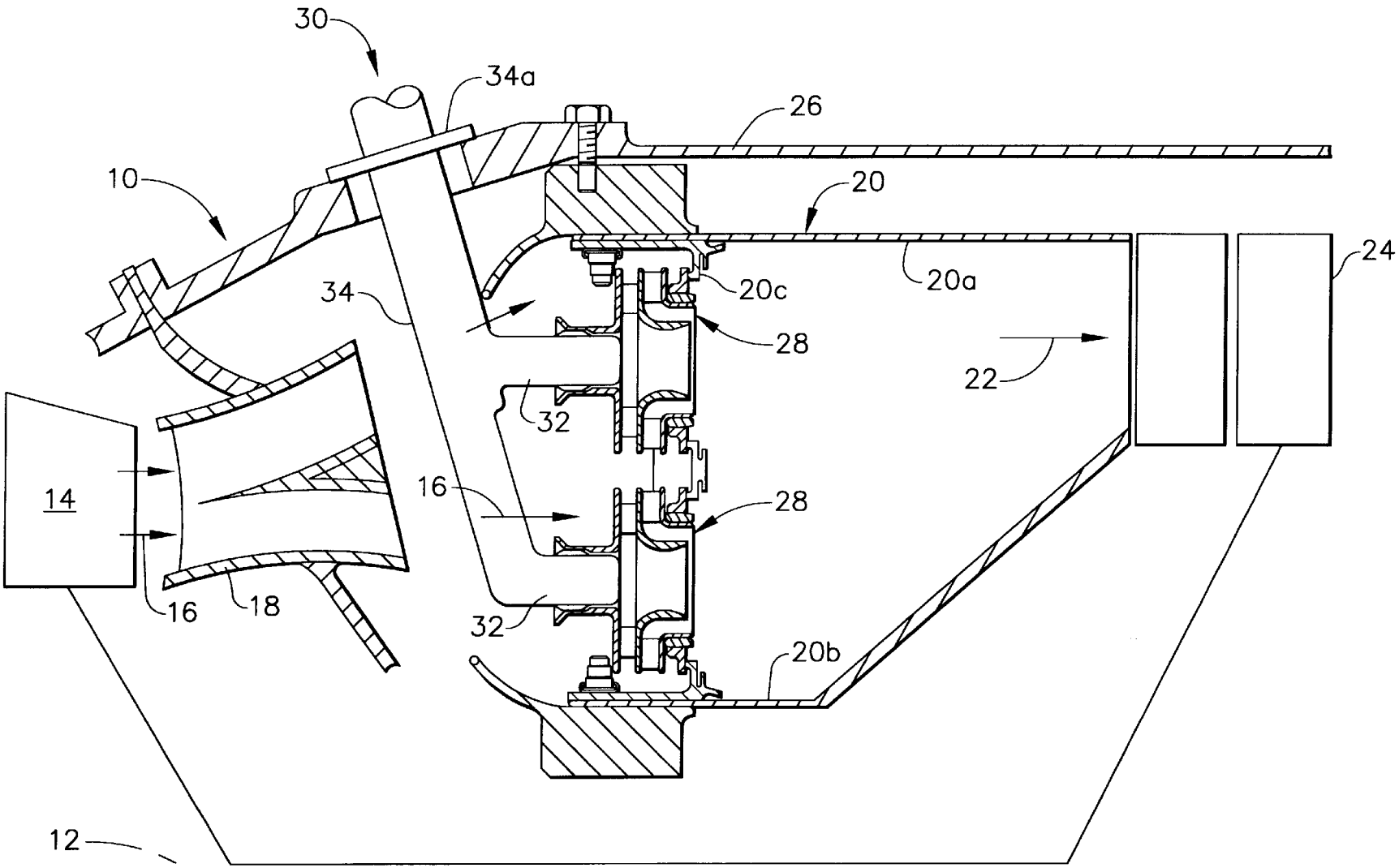
FIG. 1 is a schematic, partly sectional axial view of a portion of an aircraft gas turbine engine including a compressor, turbine, and combustor, having a self-aligning swirler in accordance with one embodiment of the present invention.

Illustrated schematically in FIG. 1 is a portion of an exemplary aircraft gas turbine engine 10 which is axisymmetrical about a longitudinal or axial centerline axis 12. The engine 10 may take any conventional form including a dual rotor turbofan gas turbine engine having a fan (not shown) followed in turn by a conventional axial compressor 14 which provides pressurized compressor discharge air 16 through an annular diffuser 18. The pressurized air 16 is channeled to a combustor 20 wherein it is mixed with fuel and ignited for generating hot combustion gases 22 which flow downstream through a conventional high pressure turbine 24 which extracts energy therefrom for powering the compressor 14 through a suitable drive shaft extending therebetween. The combustion gases 22 flow downstream from the high pressure turbine to a conventional low pressure turbine (not shown) which is joined to a fan by another drive shaft in a conventionally known manner.

The combustor 20 illustrated in FIG. 1 may take any conventional form and be modified in accordance with the present invention for decreasing both SFC and NOx emissions. In the exemplary embodiments illustrated, the combustor 20 is a double dome combustor having an annular outer combustion liner 20*a* and an annular inner combustion liner 20*b* spaced radially inwardly therefrom, which are joined together at their upstream ends by an annular combustor dome 20*c*. The downstream end of the combustor 20 defines an outlet conventionally joined to a suitable stator nozzle of the high pressure turbine.

The combustor 20 is suitably mounted inside an annular combustor casing or case 26 and provides an annular flowpath therebetween for channeling a portion of the pressurized air 16 which flows over and through conventional apertures in the combustion liners thereof. The combustor 20 is referred to as a double dome combustor since it includes two annular rows of air swirlers 28 mounted to the dome 20*c* for providing an air and fuel mixture therein. Although a double dome combustor 20 is illustrated in FIG. 1, the invention may be practiced in a single dome combustor having only one row of swirlers 28 if desired.

Each swirler 28 is mounted to the combustor dome 20*c* for receiving and mixing the pressurized air 16 from the compressor 14 with fuel 30 received from respective ones of a plurality of fuel injectors or nozzles 32. The fuel and air is discharged from each swirler 28 as a mixture which passes through the dome 20*c* into the combustor wherein it is conventionally ignited for generating the hot combustion gases 22.

The individual fuel injectors or nozzles 30 may take any conventional form for injecting the fuel into respective ones of the swirlers. Each fuel injector 32 is typically in the form of a tubular nozzle tip which is inserted into the upstream end of the respective swirlers 28 as described in more detail hereinbelow. In the exemplary embodiment illustrated in FIG. 1, the separate fuel injectors 32 of the radially outer and inner swirlers 28 are suitably joined to a common fuel inlet stem 34 which extends radially outwardly through an aperture in the combustor case 26, and includes a mounting flange 34*a* which is suitably fixedly fastened to the combustor case 26. Accordingly, the individual fuel injectors 32 are suspended from the combustor case 26 by the inlet stems 34 and therefore move radially inwardly and outwardly therewith under the different operating temperatures of the engine.

Conventional swirlers are typically fixedly mounted to the combustor dome 20*c*, with the combustor 20 being suitably supported for allowing it to float radially without restraint from the combustor case 26. Accordingly, differential thermal radial movement between conventional fuel injectors and their cooperating air swirlers must be accommodated during operation for preventing binding of the components and excessive thermal stress which would adversely affect the useful life thereof. And, conventional fuel injectors and swirlers require accurate manufacturing to ensure accurate assembly thereof for proper combustion performance during operation. Due to the manufacturing and stack-up tolerances mentioned above, optimum alignment between conventional fuel injectors and their swirlers is not achievable.

However, in accordance with the present invention, each fuel injector 32 and its cooperating swirler 28 are assembled in an improved configuration to each other and to the combustor 20 for ensuring concentricity of the fuel injector 32 and swirler 28 over the entire operating range of the engine, while providing improvement in assembly and disassembly thereof. More specifically, an exemplary embodiment of the cooperating fuel injector 32 and swirler 28 pairs is illustrated in more particularity in FIG. 2. The swirler 28 includes at its forward end a tubular ferrule or socket 36 which coaxially receives a corresponding one of the fuel injectors 32 for defining the fuel inlet of the swirler 28.

The swirler 28 may provide air swirling in any conventional manner including a first plurality of circumferentially spaced apart primary stator swirl vanes 38*a* which are fixedly joined coaxially with the ferrule 36. A second plurality of circumferentially spaced apart secondary stator swirl vanes 38*b* are also fixedly joined coaxially with the ferrule 36 and downstream from the primary vanes 38*a*. In the exemplary embodiment illustrated in FIG. 2, the primary vanes 38*a* are fixedly joined between radially extending, flat annular forward and center bands 40*a* and 40*b;* with the secondary vanes 38*b* being fixedly joined to the aft face of the center band 40*b* and to a flat, annular aft band 40*c* which extends radially outwardly from an outlet tube 42 fixedly joined thereto.

Figure 2:
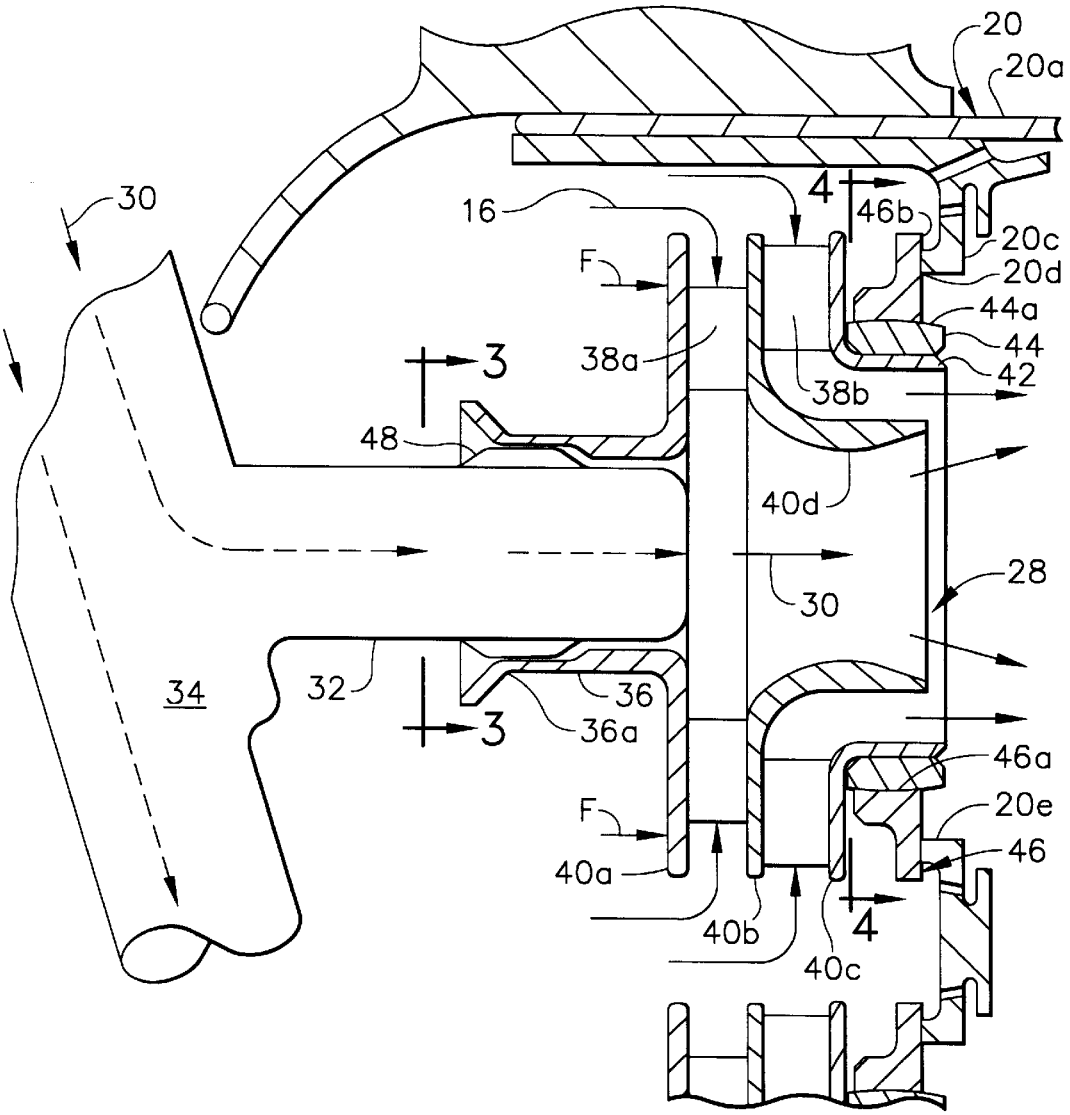
FIG. 2 is an enlarged, partly sectional elevational view of an exemplary one of the air swirlers illustrated in FIG. 1 mounted to the combustor dome for receiving a fuel injector therein.

In the preferred embodiment illustrated in FIG. 2, the ferrule 36 is fixedly joined to the outlet tube 42 as well as to the swirl vanes 38*a, b* which may be readily accomplished by casting the entire assembly thereof including the bands 40*a, b, c* in a one-piece casting. The outlet tube 42, therefore, is fixedly joined coaxially with the respective swirl vanes 38*a, b* in flow communication therewith and in flow communication with the ferrule 36 for receiving swirled air from the vanes 38*a, b,* and for receiving fuel from the fuel injector 32 mounted inside the ferrule 36.

The center band 40*b* has an axially extending bore portion which defines a conventional venturi 40*d* and separates the flowpaths between the primary and secondary swirl vanes 38*a, b*. The vanes 38*a, b* may be arranged in any conventional configuration for providing co-rotation or counter-rotation of the pressurized air 16 as desired which surrounds the fuel 30 injected from the fuel injector 32 through the venturi 40*d*. The swirled air mixes with the fuel 30 to provide a fuel and air mixture downstream of the outlet tube 42 which is ignited for generating the hot combustion gases 22.

Figure 3:
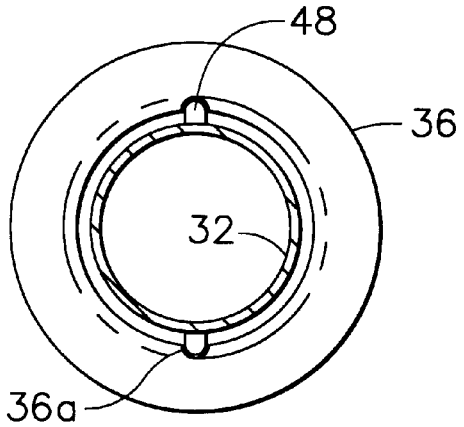
FIG. 3 is an aft facing, partly sectional radial view through the fuel injector illustrated in FIG. 2 upstream of the swirler and taken generally along line 3—3.

As shown in FIGS. 2 and 3, the tubular fuel injector 32 is simply axially received inside the tubular ferrule 36 with a suitable radial clearance therebetween on the order of several mils. The radial clearance between the fuel injector 32 and the ferrule 36 is suitably small for allowing assembly thereof while maintaining acceptable concentricity between the fuel injector 32 and the entire swirler 28. Since the swirler 28 is preferably a one-piece assembly from the ferrule 36 to the outlet tube 42, and since it closely surrounds the fuel injector 32, the swirler 28 is mounted to the combustor 20 in an improved configuration for allowing unrestrained differential radial movement therebetween due to differences in temperature during operation. Since the swirler 28 closely surrounds the fuel injector 32, and the fuel injector 32 is supported to the combustor case 26 by the inlet stem 34, the swirler 28 will float or move during operation along with the movement of the fuel injector 32 itself.

In accordance with one embodiment of the present invention, an annular collar 44 as shown in FIG. 2 is fixedly joined around the outlet tube 42 and defines a bearing ring. The collar 44 has an annular inner surface which may be conventionally press fit in an interference fit around the outer surface of the outlet tube 42. Or, the collar 44 may be brazed thereto if desired. The collar 44 includes a convex, radially outwardly facing spherical outer surface 44*a* which forms an axially truncated bearing surface.

An annular mounting ring or flange 46 surrounds the collar 44 for mounting the swirler 28 to the combustor dome 20*c* for allowing unrestrained floating movement therebetween. The mounting flange 46 has a concave, radially inwardly facing spherical inner surface 46*a* disposed coaxially around the collar outer surface 44*a* in a sliding fit therewith to define a gimbal or ball joint therewith for allowing relative rotation in three dimensions therebetween for self-aligning the fuel injector 32 with the swirler 28 during assembly and during operation.

The mounting flange 46 and collar 44 are preferably separate one-piece rings assembled together in any suitable manner. For example, the inner perimeter of the flange 46 may contain a diametrical loading slot at one side matching the sectional profile of the collar outer surface. The collar 44 may then be initially assembled perpendicularly to the flange 46 engaging together the spherical inner and outer surfaces in the loading slot, with the collar 44 then being pivoted 90° into final concentric alignment with the flange 46.

The sliding fit between the mounting flange 46 and the collar 44 allows relative rotation between these two components while also providing an effective seal against leakage of the pressurized air 16 therethrough due to the relatively close fit thereof. The ball joint defined between the flange 46 and the collar 44 allows limited cocking or pivoting of the ferrule 36 relative to the flange 46 for ensuring unobstructed assembly of the fuel injector 32 in the ferrule 36 without binding therebetween. In the event of manufacturing and stack-up tolerances between fuel injector 32 and the swirler 28, the adjustment capability between the flange 46 and the collar 44 accommodates dimensional mismatches so that the ferrule 36 may accurately coaxially engage the fuel injector 32.

Figure 4:
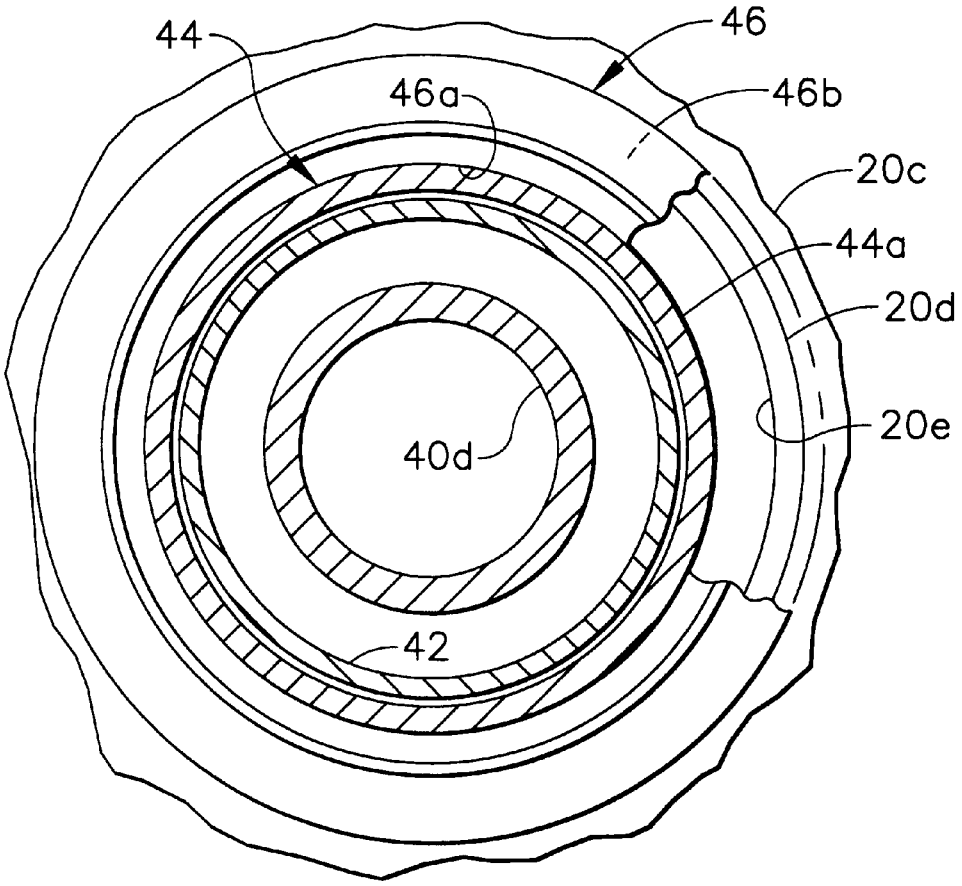
FIG. 4 is an aft facing, partly sectional radial view of a swirler outlet tube, surrounding collar, and mounting flange abutting the combustor dome as shown in FIG. 2 and taken generally along line 4—4.

The mounting flange 46 may then engage the combustor dome 20*c* for providing a suitable interface thereat. More specifically, the combustor dome 20*c* has a plurality of circumferentially spaced apart annular lips 20*d* shown in FIGS. 2 and 4 which extend axially forwardly or upstream in the form of short cylindrical tubes to define respective dome apertures 20*e* therein. The respective annular lips 20*d* provide interfaces with the respective mounting flanges 46 for providing a suitable joint at the combustor dome 20*c* while accommodating differential thermal movement between the components.

The mounting flange 46 is suitably sized and configured in radius to axially abut the forward face of the lip 20*d* coaxially therewith for allowing differential sliding radial movement therebetween during operation. The mounting flange 46 has a generally reverse L-shaped radial section with axial and radial legs, with the radial leg defining a flat annular aft face 46*b* which extends radially and is sized in radius for axially engaging the dome lip 20*d*. The flat aft face 46*b* may be an accurately machined surface for providing a sliding contact fit with the flat forward face of the lip 20*d* which may also be suitably machined. In this way, the mounting flange 46 engages the lip 20*d* in a flat joint therebetween which provide effective sealing thereat.

The compressor discharge air 16 illustrated in FIG. 2 is at a substantially elevated pressure greater than the pressure found inside the combustor 20 and therefore generates an axially aft directed force designated F in FIG. 2 which acts upon the swirler 28 to forcefully engage the mounting flange 46 against the lip 20*d* during operation. The pressurized air 16 therefore maintains the relatively tight sealed contact between the mounting flange 46 and the dome lip 20*d* to prevent undesirable leakage therethrough. However, the aft face 46*b* is allowed to slide radially and circumferentially relative to the lip 20*d* for accommodating differential thermal movement between the mounting flange 46 and the combustor dome 20*c* during operation. In this way, the swirler 28 maintains its concentricity with fuel injector 32 by being allowing to float freely relative to the combustor dome 20*c*. Decreased SFC and NOx emissions are therefore a benefit of this configuration, while also avoiding thermal binding of the components which could lead to undesirable stress and reduced life during operation.

In the exemplary embodiment illustrated in FIG. 2, the components may be readily assembled by firstly installing the individual swirlers 28 on each of the fuel injectors 32, and then bringing the combustor 20 into position adjacent to the swirlers 28. In this way, the fuel injector 32 extends axially into the ferrule 36 from the forward end of the swirler, and the mounting flange 46 adjoins or abuts the dome lip 20*d* at the aft end of the swirler 28, with the swirler 28 thereby being axially trapped or retained therebetween. The swirler 28 is not fixedly attached to the dome 20*c* itself as is typically provided in conventional combustors wherein the swirlers are brazed to the combustor dome for example. If assembled in this simple sequence, the individual swirlers 28 are trapped, yet may be readily removed by reversing the assembly process in removing the combustor 20 for providing ready access to the individual swirlers 28 which may be simply lifted away from the respective fuel injectors 32. Or, the fuel injectors 32 may be removed to provide access to the swirlers 28. Although the swirlers 28 are not fixedly joined to the combustor dome 20*c*, the pressurized air 16 created during operation provides substantial force to effectively clamp the swirlers 28 against the respective dome lips 20*d*.

The ball joint defined between the mounting flange 46 and the collar 44 allows relative rotation or pivoting movement therebetween. This is desirable during assembly of the combustor since the individual swirlers 28 may be adjusted by pivoting the ferrules 36 relative to the mounting flanges 46 for accommodating manufacturing mismatches in position of the individual fuel injectors 32 with their respective swirlers 28. Each swirler 28 may accommodate a different amount of angular offset between the fuel injector 32 and the swirler 28 while still maintaining suitable concentricity therebetween.

During operation, the pressurized air 16 flowing through the respective swirl vanes 38*a, b* may impart a torque load on the individual swirlers 28 which would cause them to rotate about the individual fuel injectors 32 which may be undesirable. Accordingly, suitable means are provided for restraining or preventing rotation of each swirler 28 around or about the dome lips 20*d* as well as about the fuel injector 32. In the exemplary embodiment illustrated in FIGS. 2 and 3, the restraining means are disposed solely between the swirler 28 and the fuel injector 32.

More specifically, at least one, and preferably two circumferentially spaced apart stand-offs or tabs 48 extend radially outwardly from each fuel injector 32 and may be integrally formed therewith in a common casting. A complementary axial slot 36*a* is disposed inside the inner surface of each ferrule 36 for receiving a respective one of the tabs 48 in an axial sliding fit therewith for restraining rotation of the swirler 28 about the fuel injector 32 during operation. As shown in FIG. 3, the two tabs 48 and their respective slots 36*a* are preferably disposed 180° apart from each other and restrain rotational movement between the ferrule 36 and the fuel injector 32 about the centerline axis of the fuel injector 32. As shown in FIG. 2, the tabs 48 are preferably spaced forwardly of the downstream end of the fuel injector 32, and the corresponding slots 36*a* extend only partially into the respective ferrules 36 to axially limit the forward travel of the swirler 28 upon the fuel injector 32.

This simple rotation restraining means maintains the simplicity of the entire swirler 28 and reduces overall parts count. The swirler 28 as illustrated in FIG. 2 is attached at its aft end to the combustor 20 solely in abutting contact between the mounting flange 46 and the dome lip 20*d,* and is removable therefrom solely by axially separating the fuel injector 32 and the combustor 20. This embodiment is characterized by the absence of any additional mounting means between the swirler 28 and the combustor 20, with the swirler 28 being simply axially trapped between the fuel injector and the combustor dome 20*c* without more, with rotational restraint being provided by the tabs 48 and any frictional engagement between the mounting flange 46 and the dome lip 20*d.*

Figure 5:
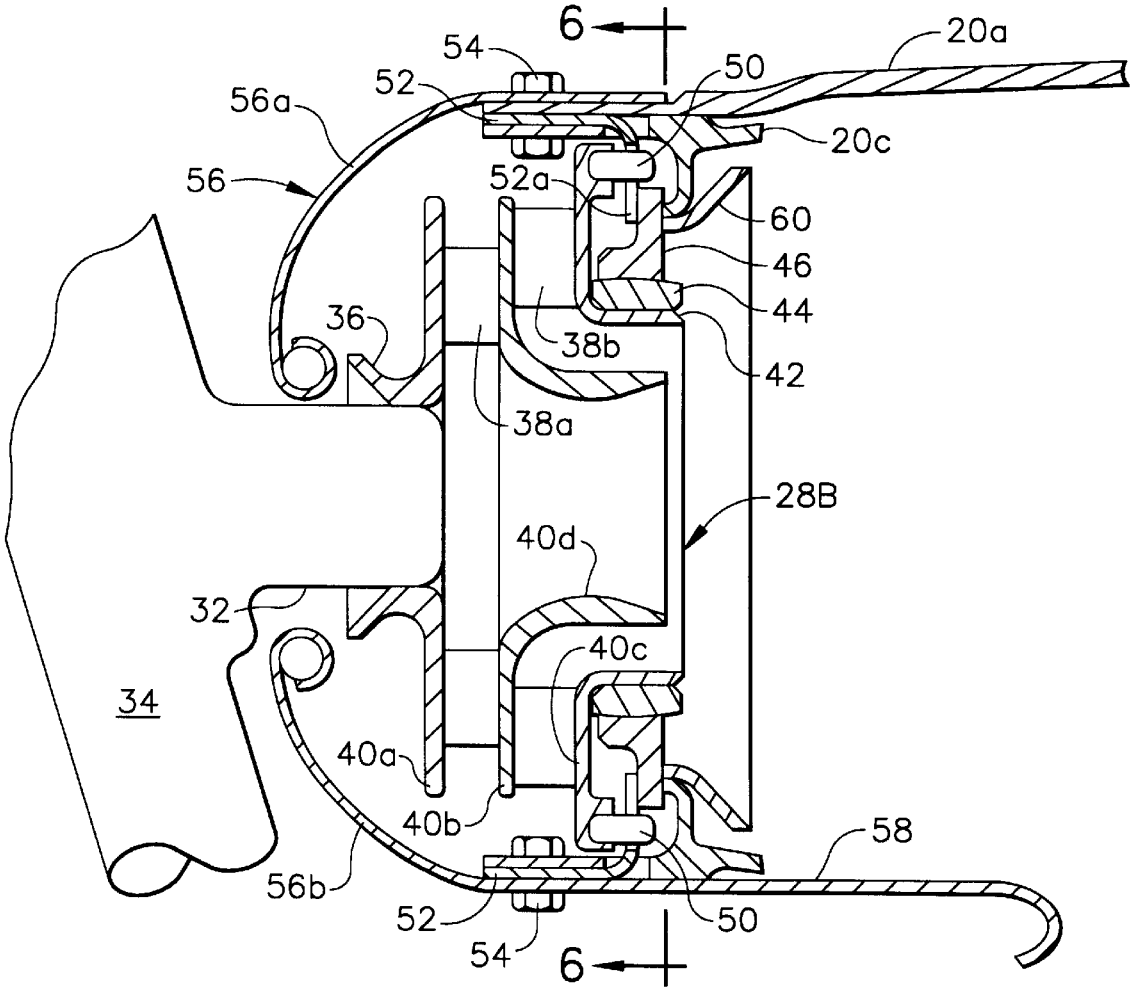
FIG. 5 is a partly sectional, axial view of a self-aligning air swirler mounted in a combustor in accordance with a second embodiment of the present invention.
Figure 6:
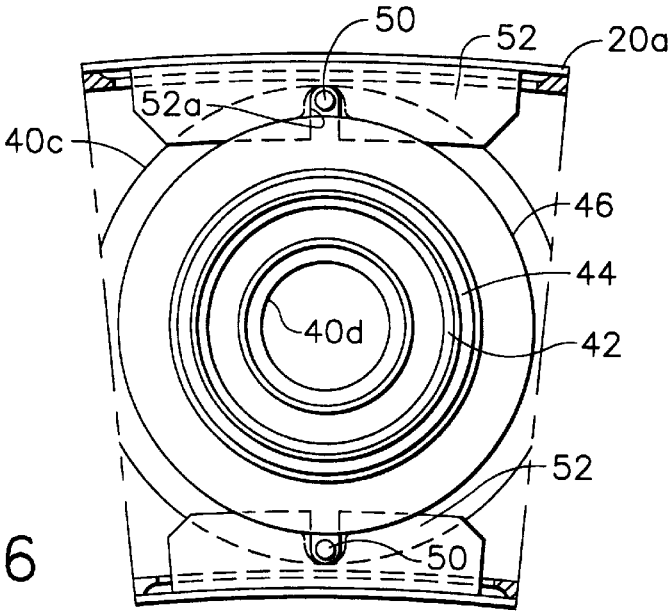
FIG. 6 is an aft facing, partly sectional radial view of the air swirler illustrated in FIG. 5 and taken generally along line 6—6.

FIGS. 5 and 6 illustrate an alternate embodiment of the present invention wherein the rotation restraining means for the swirler 28 are disposed solely between the swirler 28, at its aft end, and the combustor 20, near the dome 20c. More specifically, the swirler is designated 28B and is substantially identical to the swirler 28 illustrated in FIG. 2 except as follows. At the forward end of the swirler 28B, the ferrule 36 does not include the slot 36*a* illustrated in FIG. 2, and the fuel injector 32 does not include the tabs 48. The cylindrical fuel injector 32 simply axially engages the cylindrical socket defined by the ferrule 36 without any anti-rotation configuration therebetween.

Instead, anti-rotation is provided at the aft end of the swirler 28B by providing a radially outer extension at the aft band 40*c* from which a pair of retention pins 50 extend axially aft therefrom and are suitably fixedly attached thereto by press fits for example. The two pins 50 are disposed at about 180° apart and radially aligned with each other as illustrated in FIG. 6 relative to the engine centerline 12. A pair of corresponding circumferentially spaced apart retention clips 52 are fixedly joined to the combustor dome 20*c* around each swirler 28B, and radially extend aft of the mounting flange 46 for axially trapping the mounting flange 46 between the clips 52 and the dome 20*c*.

As shown in FIG. 5, each clip 52 has a radial leg which extends radially inwardly and axially between the aft face of the aft band 40*c* and the forward face of the mounting flange 46. The clip 52 has an axial leg which is suitably fixedly joined to the combustor using suitable bolt and nut fasteners 54. In this embodiment, the upstream end of the combustor 20 includes a conventional cowl 56 having an upper or outer portion 56*a* joined to the outer liner 20*a* at a fastener 54, and an inner portion 56*b* joined to the mid-dome at a conventional centerbody 58 by additional ones of the fasteners 54. The cowl 56 closely surrounds the fuel injector 32 and is interposed between the fuel stems 34 and the swirlers 28B.

During assembly, the individual swirlers 28B are initially positioned adjacent to the combustor dome 20*c,* with the individual retention clips 52 being positioned between the aft bands 40*c* and the respective mounting flanges 46. The individual portions of the cowl 56 are assembled into position and then the fasteners 54 are assembled, which not only retains the cowl 56 to the combustor 20, but also axially retains the individual swirlers 28B thereto. In this way, the combustor 20 with the preassembled swirlers 28B may be axially assembled into position over the preassembled fuel injectors 32, with respective ones of the fuel injectors 32 being guided into position into their respective ferrules 36.

In order to prevent rotation of the individual swirlers 28B relative to the fuel injectors 32 and the combustor dome 20*c,* each clip 52, as illustrated more clearly in FIG. 6, includes an aperture 52*a* in the exemplary form of a U-shaped slot which receives a respective one of the pins 50 for restraining rotation of the attached aft band 30*c*, and in turn the entire swirler 28B. The clip slot 52*a* has a circumferentially extending width only slightly larger than the outer diameter of the pin 50 so that the pin 50 circumferentially abuts the slot 52*a* and prevents further rotational movement thereof during operation. The radial extent of the slats 52*a* is suitably large for allowing differential radial movement between the pins 50 and the clips 52 while accommodating differential thermal expansion and contraction during operation.

In this way, the swirler 28B is axially, circumferentially, and radially restrained in movement relative to the combustor dome 20*c,* but differential radial movement between the swirler 28B and the dome 20*c* is provided. The collar 44 and the mounting flange 46 still effect the desirable ball joint thereat for allowing self-alignment between the swirler 28B and its respective fuel injector 32. And, the friction abutting joint between the mounting flange 46 and the dome lip 20*d* also accommodates differential radial movement therebetween while maintaining effective sealing thereat. In the exemplary embodiment illustrated in FIG. 5, a conventional annular splash plate 60 is brazed inside the dome lip 20*d* with conventional performance.

A significant advantage of the invention is maintaining substantially concentric alignment of the swirlers with their corresponding fuel injectors 32 during all operating conditions during which differential expansion and contraction of the combustor case 26 and combustor 20 occur. This allows a decrease in both SFC and NOx emissions.

The ball joint effected between the mounting flange 46 and the collar 44 ensures self-alignment between the fuel injector 32 and its corresponding swirler while also ensuring an effective seal between the mounting flange 46 and the combustor dome 20*c* irrespective of cocking or skewing position of the fuel injector 32 relative to the combustor dome 20*c*. This provides advantages during initial assembly of the components, as well as during operation in the engine when the various components are subject to differential thermal movement tending to cause skewing of the adjoining parts. Binding of the parts is therefore reduced or eliminated during both assembly and during operation over the operating envelope of the engine.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A swirler for mixing air from a compressor and fuel from a fuel injector for discharge to a dome of a gas turbine engine combustor comprising:

a tubular ferrule for coaxially receiving said fuel injector;

a plurality of circumferentially spaced apart swirl vanes fixedly joined with said ferrule;

an outlet tube fixedly joined with said swirl vanes in flow communication therewith and with said ferrule for receiving air and fuel therefrom, respectively, for discharge into said combustor;

an annular collar fixedly joined around said outlet tube in a fixed, concentric assembly with said ferrule, swirl vanes, and outlet tube, and said collar having a convex spherical outer surface; and an annular mounting flange for mounting said swirler to said combustor dome, and having a concave spherical inner surface disposed coaxially around said collar outer surface in a sliding fit therewith to define a ball joint for allowing relative rotation therebetween for aligning said fuel injector with said swirler.

2. A swirler according to claim 1 wherein:

said combustor dome has an annular lip extending axially to define a dome aperture; and said mounting flange is sized and configured to axially abut said lip coaxially therewith for allowing differential sliding radial movement therebetween.

3. A swirler according to claim 2 wherein said mounting flange includes a flat annular face sized for axially engaging said dome lip.

4. A swirler according to claim 3 in combination with said fuel injector and combustor, and wherein said fuel injector extends axially into said ferrule, and said mounting flange adjoins said dome lip, with said swirler being axially trapped therebetween.

5. A combination according to claim 4 further comprising means for restraining rotation of said swirler about said dome lip.

6. A combination according to claim 5 wherein said restraining means are disposed between said swirler and said fuel injector.

7. A combination according to claim 6 wherein said restraining means comprise:

a tab extending radially outwardly from said fuel injector; and a slot disposed inside said ferrule and receiving said tab in an axial sliding fit therewith for restraining rotation of said swirler about said fuel injector.

8. A combination according to claim 7 wherein said swirler is attached to said combustor solely in abutting contact between said mounting flange and said dome lip, and is removable therefrom solely by axially separating said fuel injector and said combustor.

9. A combination according to claim 5 wherein said restraining means are disposed between said swirler and said combustor.

10. A combination according to claim 9 wherein said restraining means comprise:

an annular band extending radially outwardly from said outlet tube;

a pair of spaced apart pins extending axially aft from said band; and a pair of spaced apart clips fixedly joined to said combustor dome and radially extending aft of said mounting flange for axially trapping said mounting flange therebetween, with each clip having an aperture receiving a respective one of said pins for restraining rotation of said band and in turn said swirler.

11. An apparatus for mixing air from a compressor and fuel for discharge to a dome of a gas turbine engine combustor comprising:

a fuel injector for discharging said fuel, and having a tab extending radially outwardly therefrom; and a swirler comprising:

a tubular ferrule having said fuel injector extending axially therein, and including a slot receiving said tab in an axial sliding fit therewith for restraining rotation of said twirler about said fuel injector;

a plurality of circumferentially spaced apart swirl vanes fixedly joined with said ferrule;

an outlet tube fixedly joined with said swirl vanes in flow communication therewith and with said ferrule for receiving air and fuel therefrom, respectively, for discharge into said combustor;

an annular collar fixedly joined around said outlet tube, and having a convex spherical outer surface; and an annular mounting flange for mounting said swirler to said combustor dome, and having a concave spherical inner surface disposed coaxially around said collar outer surface in a sliding fit therewith to define a ball joint for allowing relative rotation therebetween for aligning said fuel injector with said swirler.

12. An apparatus for mixing air from a compressor and fuel from a fuel injector for discharge to a dome of a gas turbine engine combustor comprising:

a tubular ferrule for coaxially receiving said fuel injector;

a plurality of circumferentially spaced apart swirl vanes fixedly joined with said ferrule;

an outlet tube fixedly joined with said swirl vanes in flow communication therewith and with said ferrule for receiving air and fuel therefrom, respectively, for discharge into said combustor;

an annular collar fixedly joined around said outlet tube, and having a convex spherical outer surface;

an annular mounting flange for mounting said swirler to said combustor dome, and having a concave spherical inner surface disposed coaxially around said collar outer surface in a sliding fit therewith to define a ball joint for allowing relative rotation therebetween for aligning said fuel injector with said swirler;

an annular band extending radially outwardly from said outlet tube;

a pair of spaced apart pins extending axially aft from said band; and a pair of spaced apart clips fixedly joinable to said combustor dome and radially extending aft of said mounting flange for axially trapping said mounting flange therebetween, with each clip having an aperture receiving a respective one of said pins for restraining rotation of said band and in turn said swirler.

* * * * *